United States Patent [19]

Kane

[11] Patent Number: 4,583,438

[45] Date of Patent: Apr. 22, 1986

[54] PIERCING UNIT WITH ROTATING HEAD

[76] Inventor: Kenneth W. Kane, 38344 Mast, Mt. Clemens, Mich. 48044

[21] Appl. No.: 543,311

[22] Filed: Oct. 19, 1983

[51] Int. Cl.[4] ..... B26D 5/16

[52] U.S. Cl. ..... 83/555; 83/556; 83/564; 83/637

[58] Field of Search ..... 83/564, 555, 535–538, 83/554, 637, 556, 557; 72/481; 100/226–228

[56] References Cited

U.S. PATENT DOCUMENTS

| | | | |
|---|---|---|---|
| Re. 10,547 | 12/1884 | Dwyer | 74/143 |
| 302,898 | 8/1884 | Dwyer | 56/433 |
| 1,153,287 | 9/1915 | Candee | 83/563 |
| 1,403,491 | 1/1922 | Eaton | 83/557 |
| 1,542,711 | 6/1925 | Loeven | 83/529 |
| 2,355,344 | 8/1944 | Wales | 83/640 |
| 3,169,302 | 2/1965 | Tethal | 72/348 X |
| 3,391,593 | 7/1968 | Jordan | 84/516 |
| 3,477,317 | 11/1969 | Liander | 83/687 X |
| 3,745,646 | 7/1973 | Kristiansson | 83/564 X |
| 3,964,358 | 6/1976 | Stefano et al. | 83/564 |
| 4,192,209 | 3/1980 | Urbanski | 83/564 |
| 4,302,998 | 12/1981 | Cantella | 83/639 |

OTHER PUBLICATIONS

E & E Engineering, Inc. Trade Literature, "Rota-Shaft Linear/Rotary Motion Clamping System".

*Primary Examiner*—James M. Meister
*Assistant Examiner*—John L. Knoble
*Attorney, Agent, or Firm*—Krass & Young

[57] ABSTRACT

Apparatus for piercing a workpiece includes a rotatable head carrying a punch, the head being designed to rotate out of vertical alignment with the die to provide unobstructed clearance above the die so that the workpiece can be easily lifted therefrom and a new workpiece positioned thereon for the next operation.

7 Claims, 6 Drawing Figures

90
70
28
66
76
92
85
80
88
50
78
52
94
48
32
46
30
34
56
62
58
64
72
82
67
84
86
40
98
44
96
74
100
104
102
36
38
42
60
54

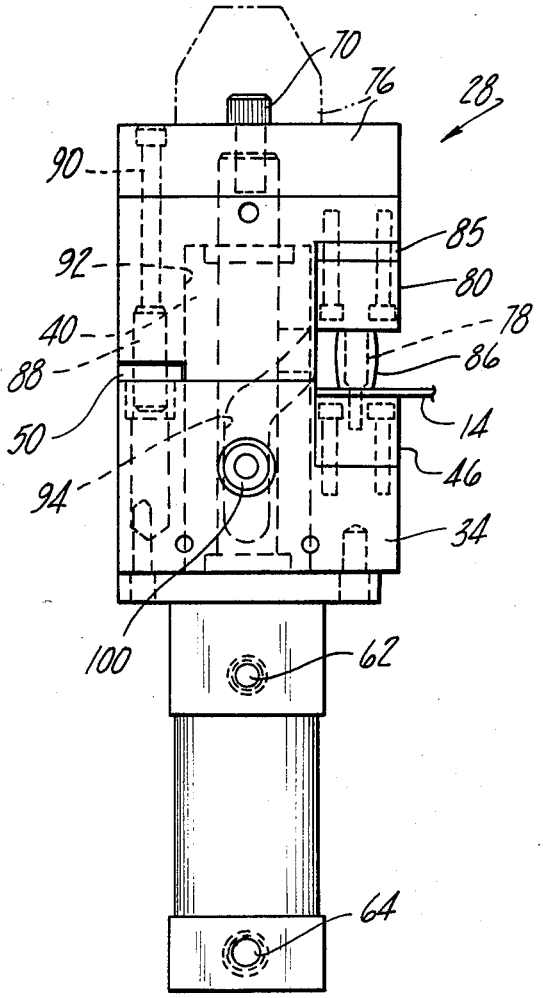
Fig-5
Fig-6
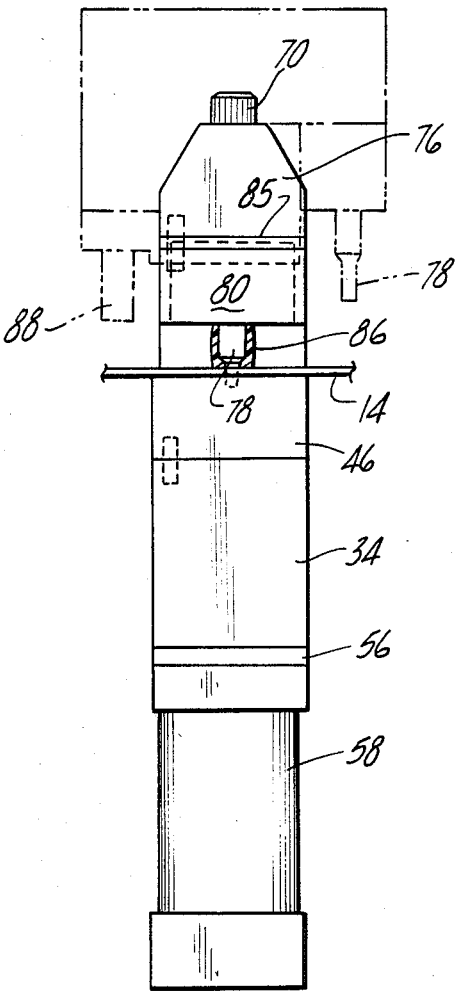

PIERCING UNIT WITH ROTATING HEAD

DESCRIPTION

1. Technical Field

This invention relates to machines for removing material from workpieces, and more particularly, to apparatus for punching or piercing material from parts.

2. Background

Piercing units, or punch presses as they are often referred to, are a class of machines that are generally used to punch out holes in workpieces. Typically, these machines include a tool in the form of a punch which is forced downwardly through the workpiece into a conforming die to punch out holes in the workpiece. Various constructions have been employed in the past to accomplish this purpose. The following is a representative, though not exhaustive, list of various prior art constructions: U.S. Pat. No. Re. 10,547 to Dwyer; U.S. Pat. No. 302,898 to Dwyer; U.S. Pat. No. 1,153,287 to Candee; U.S. Pat. No. 1,542,711 to Loeven; U.S. Pat. No. 3,391,593 to Jordan; U.S. Pat. No. 3,964,358 to Stefano et al; and U.S. Pat. No. 4,192,209 to Urbanski.

Many of the known constructions are designed so that the punch always remains in vertical alignment with the die even when the punch is retracted. Such constructions make it a cumbersome task to insert the workpiece into the tool in proper position. This is especially true where the workpiece is of a relatively complex shape and it is desired to perform simultaneous punching operations using a plurality of different tools. In such situations, it often becomes a time consuming chore for the operator to manipulate the workpiece into proper position in the various tools. The lack of vertical clearance above the die also mitigates against the use of automated equipment such as robots to load and unload the workpiece. The above-mentioned patent to Candee does provide a mechanism for moving the punch out of alignment with its die but the punch remains in a position which prevents the workpiece from being freely lowered onto the die and raised therefrom after the punching operation has been completed. Consequently, it suffers from the same problems as noted above.

Although not particularly pertinent to piercing units to which the present invention is directed, there have been clamping systems designed with a rotating member; see, e.g., trade literature distributed by E & E Engineering, Inc. of Detroit, Michigan relating to its Rota-Shaft Linear/Rotary Motion Clamping System. The construction shown therein utilizes a cam and cam slot arrangement to generate a combination of linear and rotary motion of a hydraulically actuated shaft. The construction disclosed in this literature is not designed for punching operations or piercing holes in the workpieces. There are several different design constraints that are imposed upon punching units that are different from those of clamping systems. Perhaps the most important difference is that it is of critical importance that the punch be accurately aligned with the die during the downward stroke of the punching operation. Consequently, commercial acceptance of piercing units demands close attention to stability and insuring punch/-die alignment, factors which are not necessarily of utmost importance to clamping devices.

SUMMARY OF THE INVENTION

The present invention broadly contemplates an apparatus for piercing a workpiece, the apparatus employing a rotatable head that is designed to rotate out of the way after performing a piercing operation to allow the workpiece to be easily loaded and unloaded onto the die without encountering obstruction from the punch head. A plurality of such piercing units can be arranged in an assembly to perform simultaneous punching operations on a workpiece. Such an assembly can readily accomodate even rather complex workpiece shapes due to the provision of the rotating punch head.

In the preferred embodiment, the die is mounted near one end of a fixed base. A movable head includes a downwardly extending punch located near one end thereof. A vertically extending barrel is mounted on the base and the barrel is provided with a cam slot formed therein. A shaft is slidably mounted within the barrel and is connected at an upper end to central portions of the head. Cam means are provided on the shaft for riding in the cam slot. The shaft is connected to means, such as a hydrualically actuated piston, for controlling vertical movement thereof. The cam slot is configured to rotate the head to bring the punch into alignment with the die during downward stroke of the piston. The cam slot is further configured so as to rotate the head during upward stroke of the piston to a position that provides unobstructed vertical clearance above the die so that the workpiece can be easily lifted from the base after piercing and a new workpiece loaded.

Preferably, means are located on the head and base opposite the punch and die, respectively, that engage each other when the punch is piercing the workpiece thereby maintaining the punch in accurate vertical alignment with the die. In the disclosed embodiment, these means take the form of a downwardly extending locating pin in the head which is designed to fit within an opening in the base during the downward stroke.

According to a feature of this invention, increased stability is achieved by providing a bearing surface between the head and barrel in addition to that provided between the shaft and inner portions of the barrel. This is accomplished by a construction in which the lower surface of the head has a bore generally conforming to top portions of the barrel which fit into the bore during the final portion of the downward stroke of the cylinder.

BRIEF DESCRIPTION OF THE DRAWING

The various advantages of the present invention will become apparent to one skilled in the art upon reading the foregoing specification and by reference to the drawings in which:

FIG. 5 is a side elevation view of the piercing unit; and

FIG. 6 is an end view thereof.

DESCRIPTION OF THE PREFERRED EMBODIMENT

Figure 1:
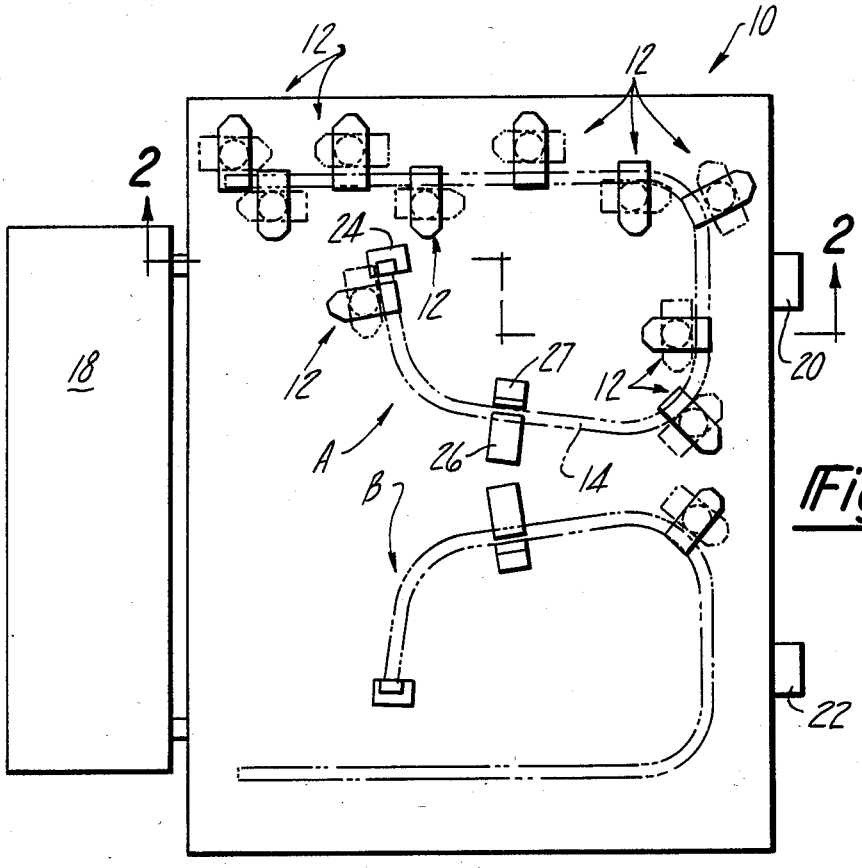
FIG. 1 is a top plan view schematically illustrating an assembly employing a plurality of piercing units to simultaneously punch holes in a workpiece.
Figure 2:
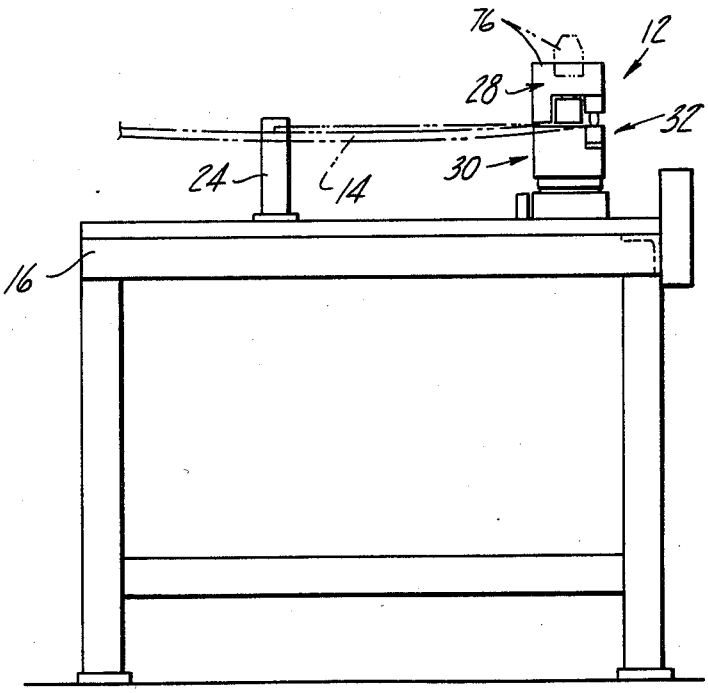
FIG. 2 is a cross-sectional view along the lines 2—2 of FIG. 1 showing one of the piercing units.

FIGS. 1 and 2 illustrate an assembly 10 utilizing a plurality of piercing units 12 to simultaneously punch holes in a workpiece 14. Assembly 10 includes two work substations A and B, substation B being substantially a mirror image of substation A and serving to permit punching operations on two workpieces simultaneously. The piercing units 12 in each substation are substantially identical except that some of them have heads which rotate in opposite directions. The piercing units 12 will be described in more detail later herein.

The workpiece 14 illustrated in these drawings is an automotive window guide track taking the form of a curved metal strip. However, it should be understood that the present invention may be used to perform operations on a wide variety of different workpiece configurations. The piercing units 12 are mounted on a suitable support surface such as table 16 in the desired locations for punching holes at different places on the workpiece 14. As will appear, the piercing units are hydraulically or pneumatically activated and the assembly 10 includes a conventional source 18 of compressed fluid such as air or oil. The operator is provided with controls 20 and 22 for activating the piercing units 12 in substations A and B, respectively. Each substation includes a stop 24 against which one end of the workpiece 14 may be abutted to aid in alignment of the workpiece with respect to the piercing units 12. An optional air clamp 26 which cooperates with a part locator 27 can be utilized in those instances where additional support of the workpiece is needed during the punching operation.

In operation, the heads 28 of the piercing units 12 are retracted from their respective bases 30. When retracted, the heads 28 are rotated into a position which is displaced 90 degrees with respect to the bases 30 as shown in phantom lines in FIG. 1. Consequently, there is an unobstructed vertical clearance that enables the operator to lower the workpiece 14 in place, resting it on the die assembly 32 and using the stop 24, if necessary, to insure proper placement of the workpiece. The operator then can activate controls 20, 22 to initiate the punching operation. During the punching operation, the heads 28 rotate into alignment with their respective bases so that the punch element becomes concentric with the die button as will be explained. When the punching operation is finished, the heads are again retracted and rotated into the offset position so that the part can be easily lifted from the piercing units without encountering any obstruction problems from the head.

FIGS. 3–6 illustrate the piercing units 12 in more detail. Base 30 includes a die block 34 having an upper surface 36 which is somewhat elongated in the horizontal direction. Central portions of die block 34 include a vertically extending bore 38 for receiving lower portions of a rotation barrel 40. Rotation barrel 40 is affixed to die block 34 by way of roll pins 42 engaging grooves 44 on the circumference of barrel 40. Die assembly mounting 32 is disposed near one end of a relieved portion in die block 34 and includes a die retainer 46 attached to die block 34 by means of screws and dowels. A die button 48 having an internal aperture designed for the type of holes to be punched is pressed into die retainer 46.

For the purposes that will be explained later herein, the die block upper surface 36 includes a locating hole disposed on the end thereof opposite die 32. In the preferred embodiment, the locating hole is formed by way of a slotted bushing 50 held in place by a lock screw 52. As will appear, the purpose of the hole defined by bushing 50 is to receive a locating pin in the head 28 during the punching operation to insure accurate alignment between the punch and die.

Die block 34 is connected by way of screws 54 to a mounting plate 56 of a hydraulically or pneumatically operated cylinder 58. Conventionally, cylinder 58 includes a piston rod 60 slidably mounted therein. Piston rod 60 slides upwardly or downwardly depending upon fluid pressure applied to ports 62 and 64.

A shaft 66 is mounted for reciprocal movement within barrel 40 whose upper end includes a wiper scraper seal 67. The lower end of shaft 66 is connected by way of a threaded coupling to piston 60. The upper end of shaft 66 is connected to head 28 by way of screw 70. A roll pin 72 passing through a transverse hole 74 in shaft 66 completes the connection to head 28.

Head 28 includes a punch block 76 having a horizontal dimension generally coextensive with die block 30 when viewed from the top. A punch subassembly is mounted on the lower surface of punch block 76 near one end. The punch subassembly includes a conventional ball lock punch 78 held in place in a retainer 80. Retainer 80, in turn, is mounted to punch block 76 by way of dowels 82 and screws 84 passing thorugh retainer 80 and a back up plate 85. The die subassembly preferably includes a conventionally used sleeve or stripper 86 which surrounds the punch 78 and aids in pushing the workpiece away from the punch as is known in the art.

A locating pin 88 is mounted by way of screw 90 so that it projects downwardly from punch block 76 and is located at an end thereof opposite punch 78. Locating pin 88 is designed to fit within the aperture of bushing 50 during the downward power stroke when the workpiece is punched. More will be said about this later.

Figures 3, 4:
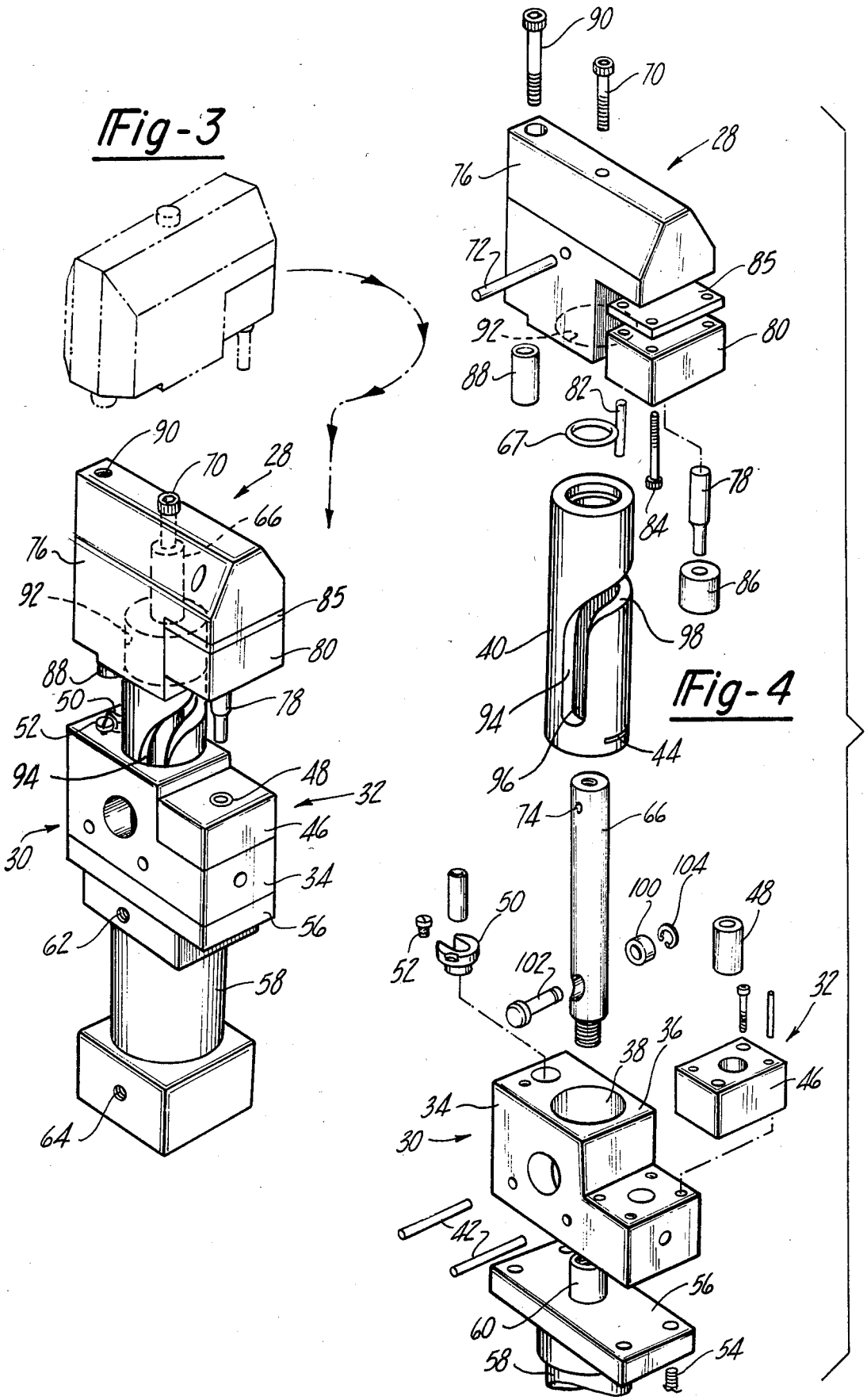
FIG. 3 is a perspective view of a piercing unit of the preferred embodiment, with the position of the head in a fully retracted position being shown in phantom lines.
FIG. 4 is an exploded perspective view of the piercing unit.

As can be seen most clearly in in FIGS. 3 and 5, the central lower portion of punch block 76 includes a vertically extending bore 92. Bore 92 is designed to provide a bearing surface for the upper circumferential portions of rotation barrel 40. The depth of bore 92 is designed so that the barrel 40 fits within it during the downward power stroke of the unit. This construction provides an additional bearing surface over and above that provided by the sliding engagement of shaft 66 within the inner confines of barrel 40. Such a construction creates good stability for the unit and mitigates against tilting of the head during the punching operation.

Barrel 40 includes a generally vertically extending cam slot 94 formed in its side. Cam slot 94 includes a linear portion 96 which blends into a helical portion 98. Shaft 66 includes a cam roller 100 that is adapted to ride in the cam slot 94. Cam roller 100 is transversely mounted to shaft 66 by way of a pin 102 and retaining ring 104.

As described above, the head 28 is oriented at a 90 degree angle with respect to the major horizontal axis of base 30 when the unit 12 is in an open position as illustrated in the phantom lines in FIGS. 1 and 3. In the open position the piston 60 is extended upwardly and the cam roller 100 is abutted against the end of the helical portion 98 of cam slot 94. The orientation of head 28 thus provides unobstructed vertical clearance above the die 32 to allow the workpiece to be easily placed into position thereon. Then, fluid is applied to the cylinder 58 to cause piston 60 to begin its downward stroke. During the downward stroke, cam roller 100 travels along the helical portion 98 of cam slot 94 thereby rotating head 28 into general alignment with base 30 when the roller 100 reaches the transition to the linear slot portion 96. Further downward movement of shaft 66 causes locating pin 88 to enter the hole defined by bushing 50. The respective vertical positions of pin 88 and bushing 50 are such that they intermesh with each other slightly before the punch 78 contacts the workpiece 14. The intermeshed engagement between locating pin 88 and bushing 50 thereby insures that the punch 78 is accurately aligned with the aperture in die button 48. Consequently, even though the head 28 is designed to rotate out of alignment for unloading/loading the parts, this construction insures accurate alignment during the critical downward power stroke of the piercing operation. In addition, the piloting nature of the bearing surface provided between head bore 92 and upper portions of barrel 40 cooperate with the additional bearing surface provided between shaft 66 and the inner surface of barrel 40 to also insure accurate alignment during the piercing operation.

The piercing operation is completed when the piston 60 finishes its downward stroke thereby forcing punch 78 through the workpiece 14 and into the die button 48. Then, fluid is introduced into the opposite cylinder port to cause piston 60 to move upwardly thereby reversing the above procedure in which the head 28 is rotated to its 90 degree position permitting easy removal of the workpiece. Preferably, the opening in bushing 50 is relieved or sloted in a direction generally parallel to the horizontal axis of base 30. By relieving the bushing opening in such manner it prevents the pin 88 and bushing 50 from locking up, yet the orientation of the relieved area does not adversely effect its punch/die alignment function.

From the foregoing, those skilled in the art can now appreciate that the present invention provides an extremely rugged and versatile machine that is capable of being used in a wide variety of different applications. Various modifications will become apparent to the skilled practitioner after a study of the specification, drawings and claims. For example, the head may be designed to pivot in a left hand direction as well as in a right hand direction merely by changing the direction of the helical portion of cam slot 94. Various punch and die configurations may be used while keeping within the spirit of this invention. Therefore, while this invention was described in connection with a particular example thereof, no limitation is intended thereby except as defined in the following claims.

I claim:

1. Apparatus for piercing a workpiece, said apparatus comprising:

A. a base assembly;

B. a die fixedly positioned on an upper surface of said base assembly;

C. a head supported from beneath by said base assembly and having a portion extending in cantivlever fashion over said die from the region of support;

D. a punch element extending downwardly from the under surface of said cantilevered head portion for punching coaction with said die;

E. means for moving said head downwardly and upwardly relative to said base assembly so as to move said punch element into and out of punching coaction with said die;

F. means operative in response to such upward movement of said head to rotate said head relative to said base assembly to a position in which said head is totally removed from the vertical projection over said die so as to allow ready access to said die for loading and unloading of workpieces; and G. locating means on said head and on said base assembly that cooperate with each other to align said punch element with said die during piercing of the workpiece.

2. The apparatus of claim 1 wherein said locating means comprises:

a pin on said base assembly or head adapted to engage a hole formed in the other of said base assembly or head.

3. The apparatus of claim 2 wherein said head is elongated and is supported from beneath intermediate its ends, wherein said pin extends downwardly from the end of said head opposite said punch element, and wherein said base assembly is elongated in general conformance with the elongation of said head, said hole is located in one end of said base assembly and said die is located in the opposite end of said base assembly.

4. Apparatus for piercing a workpiece, said apparatus comprising:

A. a fixed base having a bore vertically extending through central portions thereof;

B. a die mounted to an upper surface of the base near one end thereof;

C. a movable head having a downwardly extending punch element disposed toward one end thereof;

D. a vertically extending barrel mounted to the base in the bore and having a cam slot with a helical portion formed therein;

E. a shaft slidably mounted within the barrel and connected at an upper end thereof to central portions of the head;

F. cam means on the shaft for riding in the cam slot;

G. means connected to the shaft for controlling vertical movement thereof;

H. said cam slot being configured to rotate the head to bring the punch into alignment with the die during downward movement of the shaft and being further configured to rotate the head during upward movement of the shaft to a position that provides unobstructed vertical clearance above the die to permit easy loading and unloading of workpieces;

I. said apparatus further including locating means on the head and base opposite the punch and die respectively; and J. said locating means being adapted to engage each other when the punch is piercing the workpiece thereby maintaining the punch in accurate alignment with the die.

5. The apparatus of claim 4 wherein said locating means comprises:

a downwardly extending pin fixed to the head on an end opposite the punch; and a hole formed in the base upper surface on one end opposite the die.

6. The apparatus of claim 5, wherein said hole is defined by a slotted bushing having a relieved opening extending in the direction generally parallel to the major horizontal axis of the base.

7. The apparatus of claim 4 wherein said head includes a bore therein for receiving top portions of the barrel during piercing operations of the workpiece thereby providing a bearing surface therebetween.

* * * * *